United States Patent [19]

Perret-Gentil

[11] Patent Number: 5,015,121

[45] Date of Patent: May 14, 1991

[54] OFFSHORE EROSION PROTECTION ASSEMBLY

[76] Inventor: Hubert B. Perret-Gentil, 2 Jean Lafitte La., Key Largo, Fla. 33037

[21] Appl. No.: 495,634

[22] Filed: Mar. 19, 1990

[51] Int. Cl.[5] ..... E02B 3/06

[52] U.S. Cl. ..... 405/31; 405/33; 405/35

[58] Field of Search ..... 405/15, 21, 25, 27, 405/30, 31, 33, 34, 35

[56] References Cited

U.S. PATENT DOCUMENTS

| | | | |
|---|---|---|---|
| 227,483 | 5/1880 | Case | 405/35 |
| 315,384 | 4/1885 | Boynton | 405/30 |
| 905,596 | 12/1980 | Smith | 405/21 |
| 1,140,140 | 5/1915 | Everett et al. | 405/35 |
| 1,353,001 | 9/1920 | Uriarte | 405/35 |
| 1,610,341 | 12/1926 | Wells | 405/21 |
| 1,858,976 | 5/1932 | Thornley | 405/35 |
| 3,280,569 | 10/1966 | Wosenitz | 405/34 |
| 3,415,061 | 12/1968 | Staempfli | 405/34 |
| 3,844,125 | 10/1974 | Williams | 405/33 |
| 3,846,988 | 11/1974 | Lamy | 405/31 |

FOREIGN PATENT DOCUMENTS

| | | | |
|---|---|---|---|
| 2393110 | 2/1979 | France | 405/30 |
| 2476712 | 8/1981 | France | 405/30 |
| 977338 | 12/1964 | United Kingdom | 405/35 |

*Primary Examiner*—David H. Corbin

*Attorney, Agent, or Firm*—Malloy, Downey & Malloy

[57] ABSTRACT

An offshore erosion protection structure comprising a barrier assembly having an elongated configuration and running substantially parallel in corresponding relation to the configuration of the shoreline and defined by a plurality of spaced apart and successively arranged modules specifically structured, configured and disposed to reverse the erosion of sand by waves of various strength on the shoreline by decelerating the travel of the incoming waves. The sand, held in suspension by the wave caused turbulence, will settle out in the near-shore zone thereby creating a tendency of reversing erosion by adding sand to the shoreline or beaches.

22 Claims, 3 Drawing Sheets

FIG. 1
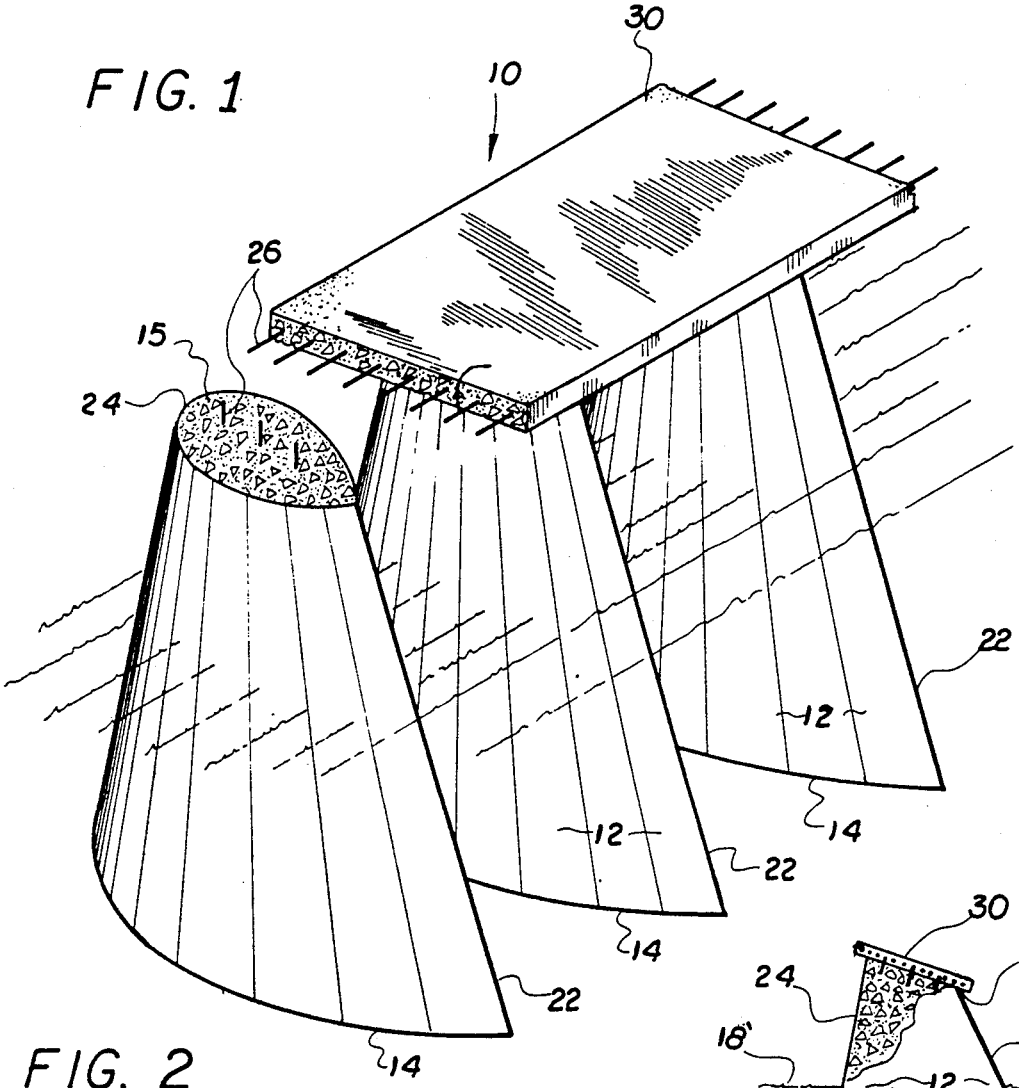
FIG. 2
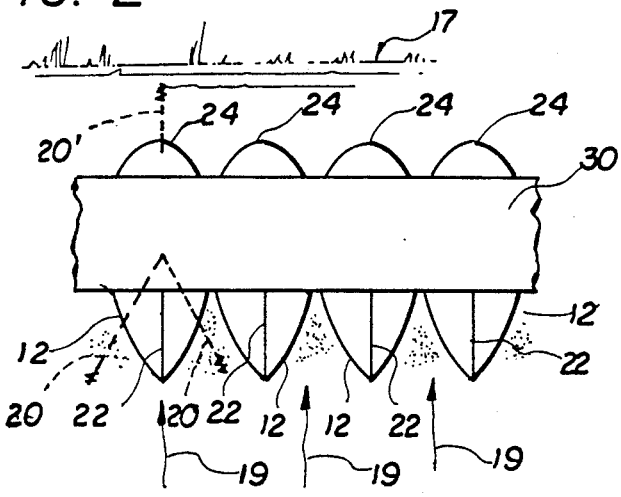
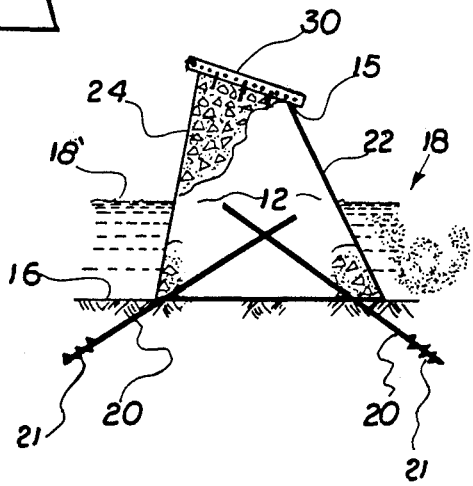
FIG. 3

FIG. 4
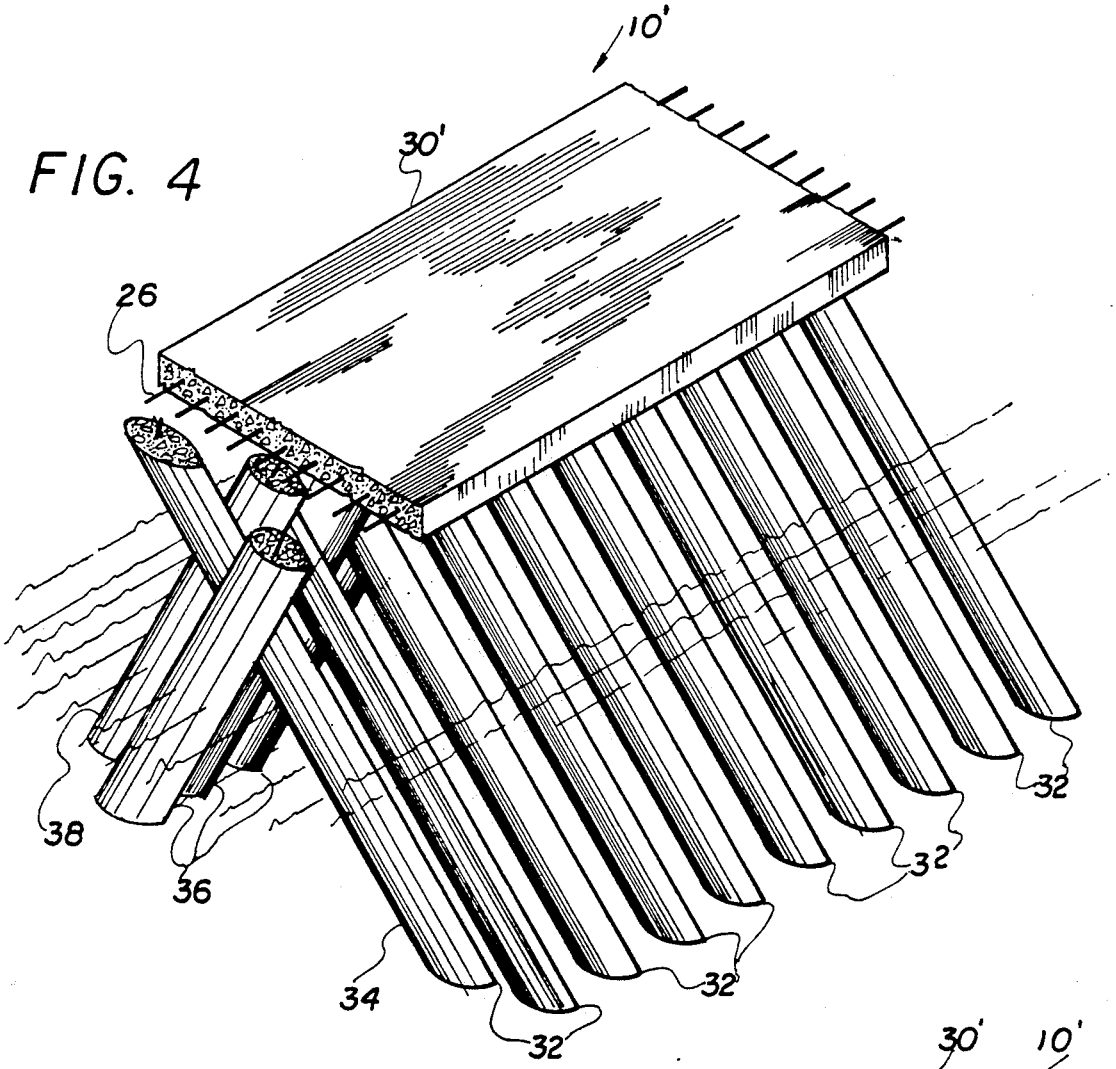
FIG. 5
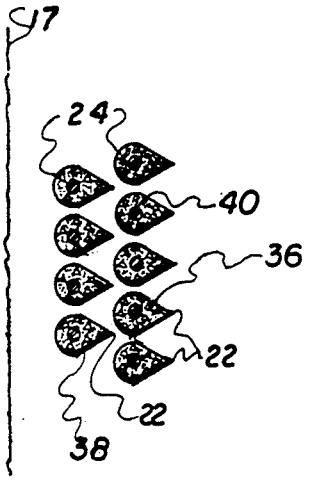
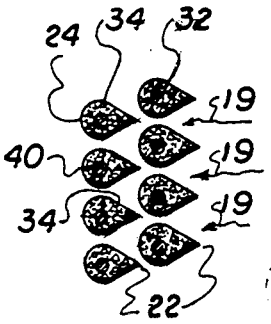
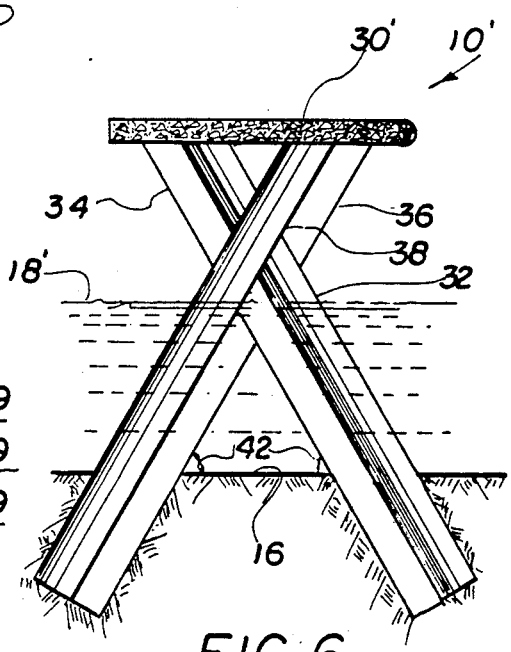
FIG. 6

FIG. 7
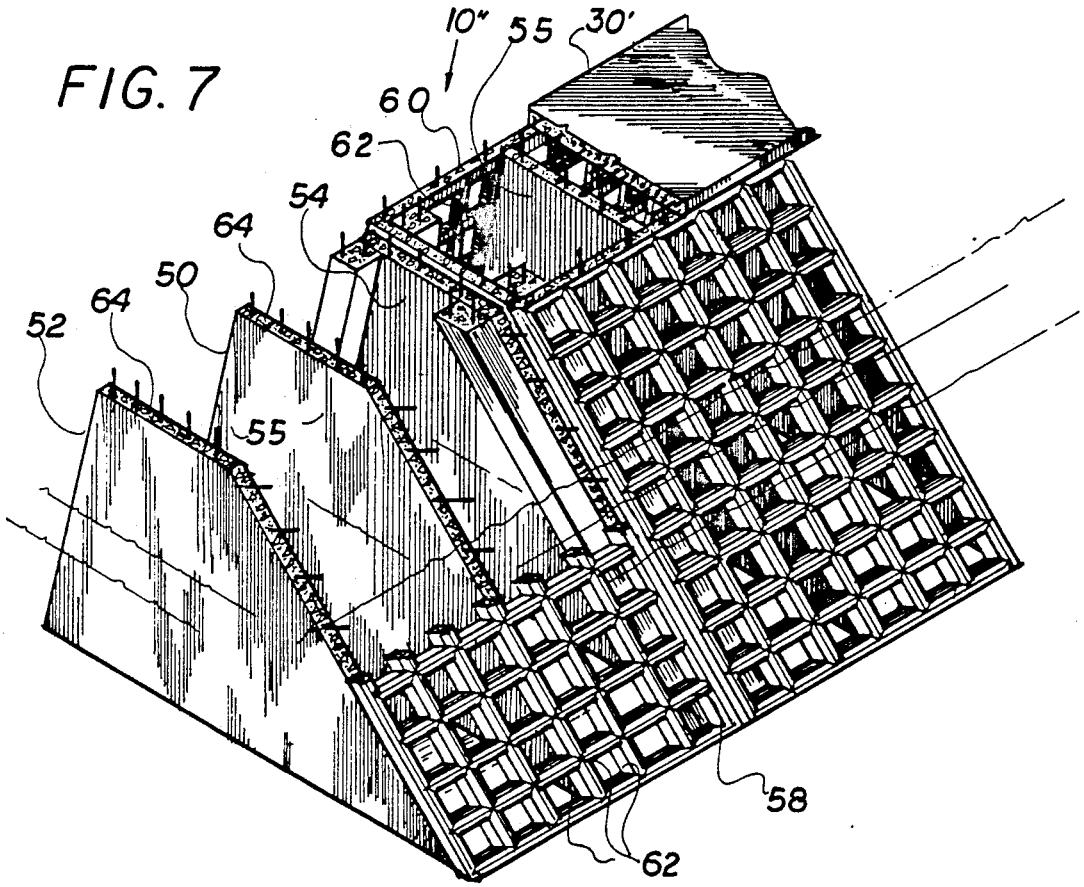
FIG. 8
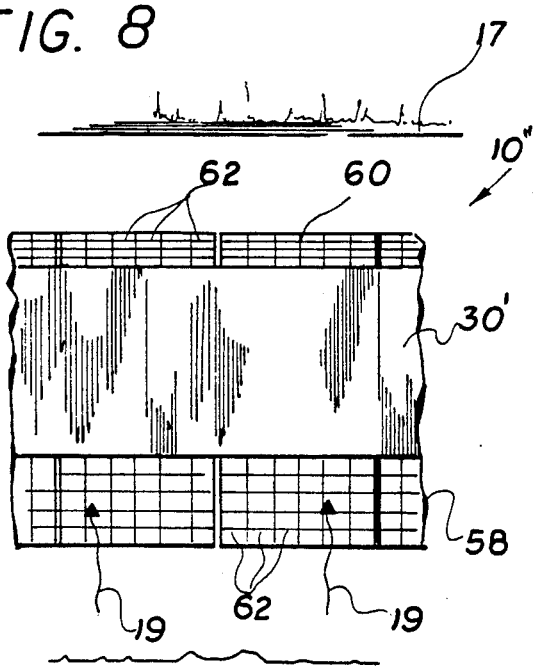
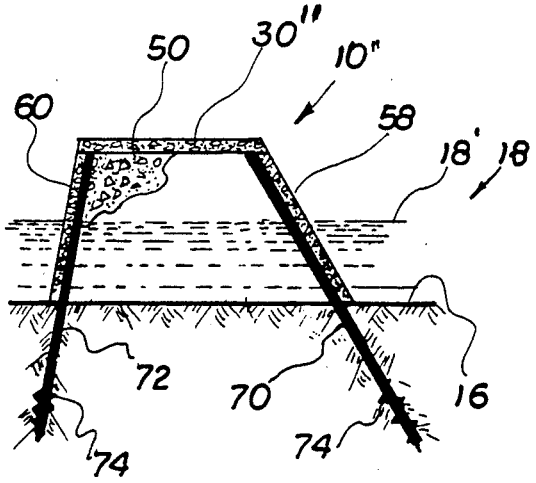
FIG. 9

OFFSHORE EROSION PROTECTION ASSEMBLY

BACKGROUND OF THE INVENTION

1. Field of the Invention

This invention relates to a barrier assembly mounted in an offshore disposition within a body of water by anchoring the barrier to the floor or bottom and structuring the barrier assembly to intercept inflowing waves of a variety of strength thereby dissipating the force of such waves before the waves can derogatorily affect the sand on or about the shoreline which normally causes erosion.

2. Description of the Prior Art

Numerous prior art structures and devices have been devised to reduce or eliminate the tendency for beach or shoreline erosion caused by waves varying in strength from generally normal continuous wave action to storm or hurricane level. Certain existing publications in the United States have emphasized the importance of conservation of the nation's shoreline as indicated hereinafter.

*Science Digest,* August 1986 Volume, "America Washing Away" indicates that the sea level throughout the world is rising from a negligible six inches over the past century to a possible one foot or more within the next fifty years. Each foot of sea level rise can destroy from approximately one hundred to many thousand feet of coastline. The forces responsible for such erosion are beyond anyone's control as well as general scientific understanding. Within the next ten years, homes in every coastal town and on every barrier island will be at risk of being destroyed if hurricanes or storms of sufficient strength occur.

It is also well known that the abnormal rising of sea level could very well be attributed to "global warming" which according to many prestigious and nationally sponsored societies may well be the most pressing international issue of the next century.

Storm surges and high tides could flood hundreds of abandoned toxic waste sites located near the coasts thereby directly threatening human health by contaminating ground water.

Cities such as Miami Beach, Fla.; Ocean City, N.J.; East Hampton, N.Y. and Malibu, Calif. have attempted to stop such derogatory effects on the adjacent shorelines by building walls in front of the beach area to hold back the sea. Additional efforts include the creation of jetties to stabilize inlets and the establishment of stone groins that extend perpendicular outward from the beaches into the water for the purpose of trapping sand. In many cases, these structures have accomplished the opposite of that intended and have in fact hastened erosion.

The only way to widened or re-establish a beach uniformly and protect all of the contiguous property is to replenish such beach or coastline with new sand. Importing and is prohibitably expensive to all but the wealthiest resorts and individuals.

In the July 1987 issue of *Scientific American* and article entitled "Beach and Barrier Islands" indicated that one of the world's most spectacular sand beaches runs from the New England area of the North American continent down the Atlantic coast of the United States and travels continuously around the State of Florida to extend along the northern edge of the Gulf of Mexico. Much of the 2,700 mile beach lies on the 295 "barrier islands" that stand between the sea and the mainland along the two coasts. Both the mainland beaches and the islands are under constant attack from the sea. Today, such resorts, of the type mentioned above, occupy barrier islands and summer homes crowd many of such beaches. Naturally, pressure for pubic works to protect the islands and beaches is strong. It is impossible for a large storm of hurricane strength to move along either coast without either crossing or at least affecting a beach or barrier island. Hurricanes are more powerful than storms known as Winter Northeasters, but they come less often, particularly along the Atlantic coast. There are roughly thirty occurrences wherein Northeasters generate waves with sufficient force to erode the barrier island beaches and frontal dunes.

The overall shoreline erosion along the mid-Atlantic coast is from 1.5 to 4.5 feet per year. This does not apply to the barrier islands off the Virginia coast and the beaches along the Delta coast of Louisiana. There the erosion rate can be as much as 25 feet per year.

The aforementioned article additionally sets forth that in 1946, Congress first authorized the expenditure of federal funds to build structures to prevent erosion. Under that authority, the Army Corps of engineers built more than a hundred projects. These projects encompass both "hard" structures and "soft" engineering works. The hard structures include breakwaters, groins, sea walls and revetments. The latter structure, a revetment is built on the beach to prevent waves from removing sand. Experience has learned that manmade structures of the type set forth above have not only failed to protect the beaches and shorelines but in many cases, have actually worked to destroy them. The trend in coastal engineering today is to take the soft approach. This technique entails adding sand to a beach to replace material lost by natural erosion.

The continuing rise in sea level and encroachment on the shoreline will challenge engineers seeking to maintain the resort communities built on beaches and barrier islands. If the predicted increase in atmospheric carbon dioxide from the burning of fossil fuels brings about a global warming and increased melting of polar ice, th e sea level will rise even faster and shoreline recession will accelerate.

The articles described the deteriorating condition of the American beaches and the resulting hazardous situation involving coastal residential constructions. The Conservation Foundation for the Counsel on Environmental Quality, the Departments of Commerce, Defense, Interior, Environmental Protection Agency and the Federal Emergency Management Agency have prepared guidelines for conservation of resources and protection against storm hazards, titled "Coastal Environmental Management". The six objectives recommended in this manual for communities to consider in developing "management policies" are:

1. Manage coastal watersheds for least alteration of natural patterns of storm water runoff.
2. Preserve ecologically vital areas, such as dunes, coral reefs, wetlands, and edgezones (borders of distinctive vegetation between different areas-e.g. between wetlands and floodlands).
3. Preserve the integrity of coastal geologic protective structures.
4. Protect the configuration of coastal water basins against adverse alteration.
5. Protect coastal waters from pollution.
6. Restore damaged environments.

Heeding these recommendations recommend three separate designs of marine structures to be proposed herewith to preserve indirectly the integrity of geological and architectural coastal structures by safeguarding the nearshore zone (the submerged beach extending seaward as far as the force of waves reaches to the bottom) by making it nourish itself with sand utilizing a natural technique. To accomplish this, the theorem cited by Mr. Willard Bascom in his book, "Waves and Beaches" is put into practice. This practice is set forth by the statement that sand set in motion by wave caused turbulence will settle out wherever a protective structure reduces wave action. This assumption has been actually proven in nature on the island of Curacao, Netherlands-Antilles, in the Caribbean.

The proposed structures will not only add sand to the nearshore zone, but will also help reduce the severity of storm surges and flooding. This is accomplished in the same manner mangrove swamps and coral reefs are credited with saving the shoreline but in a more organized way without hiatuses.

Accordingly, there is a need for protective structures and assemblies mounted offshore which are designed, disposed and configured to reduce the wave energy by refraction (in marine terms meaning bending). Waves moving into a preferred structure or barrier assembly will also slow down by the friction caused by the obstacles course they are put through and that between the water particles reciprocally. Though part of the slowing down process will be caused by reflection, the utmost care is taken in the design of a preferred structure in order to offer the least resistance to the incoming waves. The powerful breakers, holding sand in suspension, get stripped of most of their energy after passing such a preferred barrier assembly and will release and add the suspended sand into the nearshore zone. With this action, the much feared erosion will be reversed and it will be a matter of time for the nearshore zone to silt up, sweep up enough sand to build dunes which will integrate coastal geologic protective structures.

The aforementioned prior art structures which are manmade are generally representative in the U.S. Pat. No. 4,647,290 to Grooms. Grooms recognizes that many and various techniques have heretofore been employed in conjunction with tidal waters, particularly along the coastline to attempt to cause sand carried by the water to settle therefrom during wave movement and thus achieve accretion. To date, such efforts have not met with any significant success. The Grooms' invention is not easily adaptable for large scale operations. It includes moving parts which make it vulnerable and costly from an operation and maintenance standpoint. The land accretion apparatus proposed by Grooms comprises a base support having a flexible barrier secured thereto. Apart from its operation, the following can be said of the flexible vertical barrier, which represents the most important part of the invention. The existence of a manmade material that can survive for a long constant back and forth bending motion brought about by the continuous wave action is questionable.

SUMMARY OF THE INVENTION

The present invention is directed towards a barrier assembly for protecting beaches and shorelines through the prevention of erosion of sand therefrom by reversing the process of gradual erosion brought about during stormy weather. Generally, the barrier assembly of the present invention is represented in three embodiments to be described in greater detail hereinafter which are generically similar by comprising a plurality of consecutively disposed wave dissipating modules to be constructed in the ocean, sea or body of water generally parallel to and in conformance with the configuration of the coast line. The barrier assembly of the present invention will help reduce the severity of storm waves, control storm surges and flooding in much the same manner mangrove swamps and coral reefs are credited with this achievement but in a much more organized way. Each of the aforementioned embodiments of the subject barrier assembly will reduce the wave energy by refraction and by friction because of the obstacle course and the "lifting" the subject structures have on the waves. The barrier assembly of the present invention are designed and constructed in such a manner as to avoid as much as possible any reflection of the waves. To counteract wave pressure and buoyancy, the subject structure is made of a concrete or like material anchored by piles and reinforced and bound together at least partially by means of an elongated deck attached to the upper most ends of the aforementioned wave dissipating modules.

In operation, the waves are stripped of most of their energy by passing through the modules of the subject barrier assemblies. The waves, having a tendency to hold sand in suspension while in a turbulent state, will release and add the suspended sand to the nearshore zone behind the barrier assembly. This accumulation will in effect reverse erosion and start building or replenishing the beach and shoreline area. Finally, after sufficient time has elapsed, the wind will cause the delivery of the new sand to the dryer portions of the beach and feed it back to the shore and the dunes and thereby restore the protective coastal structure.

BRIEF DESCRIPTION OF THE DRAWINGS

For a fuller understanding of the nature of the present invention, reference should be had to the following detailed description taken in connection with the accompanying drawings in which:

FIG. 1 is a perspective view in partial cut-away of one preferred embodiment of the present invention FIG. 2 is a top plan view of the embodiment of FIG. 1 in partial cut-away.

FIG. 3 is a transverse sectional view of one module of the preferred embodiment of FIG. 1.

FIG. 4 is a perspective view of another embodiment of the present invention in partial cut-away.

FIG. 5 is a top transverse sectional view of the embodiment of FIG. 4.

FIG. 6 is a transverse sectional view of the embodiment of FIG. 4.

FIG. 7 is a perspective view in partial cut-away of yet another embodiment of the present invention.

FIG. 8 is a top plan view of the embodiment of FIG. 7 in partial cut-away.

FIG. 9 is a transverse sectional view of the embodiment of FIG. 7.

Like reference numerals refer to like parts throughout the several views of the drawings.

DETAILED DESCRIPTION OF THE PREFERRED EMBODIMENT

The present invention is directed towards a barrier structure for dissipating the force of waves to the extent that sand normally suspended in waves due to their turbulence is deposited generally in the shore zone thereby reversing the effects of erosion such waves would normally occur. In one preferred embodiment represented in FIGS. 1 through 3, a barrier assembly is generally indicated as 10. This barrier assembly comprises a plurality of upstanding modules 12 with the angled side facing the general direction of the waves having base portions thereof as at 14 mounted on and secured to the floor 16 of a body of water 18 and generally offshore a distance sufficient to effectively encounter waves prior to their landing on the shoreline. While the size of the modules 12 may in fact vary depending upon the particular application and site of installation, they are preferably of sufficient height and overall dimension to extend at least fifteen feet above the normal water level as at 18' (see FIG. 3). The mounting or securement is accomplished by three or more elongated anchors as at 20 embedded in the floor 16 to anchor the modules as secure as possible to withstand the waves from hitting the front from all directions. The anchors 20 may be somewhat angled away from one another and each includes a specifically shaped head at an outer end thereof to facilitate securement of the anchor 20 as shown.

Each of the modules 12 are aligned in an immediately adjacent, side-by-side relation to one another such that the bases thereof as at 14 either touch or are in immediately adjacent or confronting position relative to one another. Each of the modules includes a front facing portion defined in the embodiment of FIG. 1 by an elongated edge 22 defining a leading portion of each of the modules as shown. The leading or facing edge 22 is disposed generally away from the shoreline and towards the incoming waves. The edge 22 generally is cooperatively structured with the remainder of the transverse cross-sectional configuration of each of the modules 12 to resemble that of the bow of a boat in at least a general fashion. Further, as is apparent the base 14 is significantly larger in size than the upper end as at 15 of each of the modules 12. However, the transverse cross-sectional configuration is generally consistent or congruent throughout the entire length or "height" of each of the modules 12. This is due to the fact that the base, in a preferred embodiment, being four times larger than the upper end 15, consistently tapers or reduces in size from the base to the upper end 15. The overall configuration is defined by the leading edge 22 as the front facing portion and a somewhat rounded trailing portion as at 24 disposed opposite to the edge 22. Further, each of the modules 12 is formed from a somewhat cementitious material such as reinforced concrete and may have rebars as at 26 extending throughout each of the modules 12 as well as an interconnecting and at least partially supporting deck 30.

The deck 30 has an elongated configuration also being formed from a reinforced concrete or like cementitious material with rebar 26 extending throughout. The deck is of sufficient length to interconnect a plurality of adjacent or consecutively positioned modules 12 about their upper end. Further, as shown in FIG. 3, the deck 30 is slanted in a somewhat declining orientation towards the waves and away from the shoreline as shown. This angular orientation further facilitates encountering a plurality of waves on a consecutive basis in a manner which will serve to dissipate the waves' strength and maintain the sand in suspension in the waves for deposit behind the barrier structure 10 generally along the nearshore zone as defined above.

In each of the three different embodiments represented respectively in FIGS. 1–3, 4–6 and 7–9, the shoreline is generally represented as 17 and the incoming waves are represented by directional arrows 19.

In the embodiment of FIGS. 4 through 6, a different type of construction is used for the barrier assembly 10' and is perhaps more applicable and efficient wherein waves of greater strength are more frequently required. The barrier assembly 10 comprises a plurality of modules, the cross-section of which corresponds at least initially to the cross-section of the modules 12 in FIG. 1 in that a leading longitudinal edge as at 22 is integrally formed on a front or leading portion of each of the modules and the trailing portion as at 24 is more rounded. More specifically and as best shown in FIG. 4, a first number of modules 32, 34 forms a front set wherein the modules are spaced from one another and also staggered into a leading row of modules 32 and a trailing row of modules 34 (see FIG. 5).

Similarly, a second set of modules 36, 38 is disposed in spaced relation to one another along the length of the barrier structure in the same spaced and staggered relation to define a rear set. Each of the modules 32, 34, 36, and 38 has the same cross-sectional configuration, as represented in FIG. 5, and each further includes a central core of high strength material such as steel extending along the entire length thereof coincident to the central longitudinal axis as at 40. A reinforced cementitious material such as concrete is formed about each of the cores 40 to form the transverse configuration as represented in FIG. 5 including the leading edge 22 and the trailing rounded portion 24. FIG. 5 is a transverse sectional view representative of all the modules 32, 34 and 36, 38 as shown. It is important to note that each of these modules 32, 34, 36 and 38 has a substantially consistent transverse dimension along their entire length. The base or lower end thereof is embedded in the ocean floor 16 at an angled orientation of preferably 60° as indicated as 42. In a further preferred embodiment, the overall configuration and dimension of each of the cooperating or immediately adjacent modules on the front and rear rows form generally an equilateral triangle as pictured in FIGS. 4 and 6. Finally, each of the modules is interconnected at their upper ends by a deck structure as at 30' also formed of a reinforced concrete material being replete with rebar 26 throughout. The reinforcement being in conformity with civil engineering practice for maximum strength. As is also evident, the front or facing portion of each of the modules defined by the elongated edge 22 is directed towards the incoming waves as indicated by directional arrow 19 and away from the shoreline 17.

With regard to the embodiment of FIGS. 7 through 9, the structure is somewhat different. More specifically, the barrier assembly 10'' comprises a plurality of modules defined by at least three walls 50 defining a center wall, 52 and 54 defining side walls. The walls are disposed in spaced apart relation to one another and are substantially parallel. In a preferred embodiment, the walls have a somewhat trapezoidal configuration such that the base portions thereof are secured to or mounted on the floor of the body of water as at 16. Each of the walls raises to a height such that at least approximately fifteen feet extend above the normal sea level or water level 18'. The walls 50, 52 and 50, 54 are disposed a sufficient spaced apart distance to define chambers 55 there between through which water from the incoming waves travels. The barrier assembly 10'' further includes a leading portion defined by a grid like front wall 58 and a trailing portion defined by a rear grid like wall structure 60. The walls 58 and 60 have an apertured construction including a plurality of openings or apertures 62 formed therein and being of sufficient dimension to allow water from incoming waves to pass into the various chambers 55 and out of these chambers by respectively engaging and passing through the apertures 62 of the front facing wall 58 and passing out of the apertures 62 of the rear facing wall 60. An interconnecting deck 30'' is secured to the upper ends 64 of each of the walls or modules 50, 52, 54, etc. so as to effectively cover the top end thereof when cooperatively position with the front and rear walls 58 and 60. Again, the material from which the center walls, side walls, front and rear apertured walls 58 and 60, and top deck 30'' are formed all may be a cementitious reinforced material such as concrete. Attachment, mounting and support occurs by angularly oriented anchors as at 70 and 72 having their bottom most end 74 embedded within the floor 16 of the body of water 18 and enlarged or shaped to facilitate the anchoring as shown. The upper end of the anchors are connected by conventional means, such as cement, both to the inner surface of at least one of the side walls 52 or 54 (and preferably both) as well as the inner surface of the front and trailing walls 58 and 60. This is clearly shown in both FIGS. 7 and 9.

Now that the invention has been described,

What is claimed is:

1. An offshore erosion protection structure designed to reduce sand erosion from wave action and comprising:

a barrier assembly anchored to the floor of a body of water and extending upwardly therefrom to a height sufficient to extend above a normal water level, said barrier assembly comprising a plurality of modules formed at least in part from a heavy, reinforced cementitious material and arranged in consecutive adjacent and at least partially spaced relation to one another, said plurality of modules disposed offshore from a shoreline of the body of water and collectively disposed to conform in substantially parallel relation to and along a length of the shoreline, said barrier assembly including a leading portion facing away from the shoreline and being angularly disposed at an inclined orientation substantially toward the shoreline, each of said plurality of modules including a leading edge having a linear configuration and extending continuously along a length thereof, a plurality of leading edges on said plurality of modules disposed in spaced relation to one another, and each of said plurality of modules further including a substantially rounded trailing portion extending along the length thereof and being oppositely disposed to a corresponding one of said leading edges, wherein said plurality of modules are collectively disposed and structured to force incoming waves to dissipate and pass therebetween along substantially an upper, exposed portion thereof.

2. An assembly as in claim 1 wherein said plurality of modules are collectively disposed in side-by-side disposition and in immediately adjacent confronting relation to one another along base portions thereof.

3. An assembly as in claim 1 wherein each of said plurality of modules comprises a continuously reduced transverse dimension along its length from said base to an upper end thereof, a space between adjacent ones of said modules increasing from said bases to said upper ends thereof.

4. An assembly as in claim 3 wherein each of said plurality of modules comprises a base substantially four times the size of said upper free end thereof.

5. An assembly as in claim 3 wherein each of said plurality of modules comprises a congruent transverse cross-section along its length.

6. An assembly as in claim 1 wherein a number of said plurality of modules are connected to one another by an elongated deck secured to said upper ends of said number of modules.

7. An assembly as in claim 6 wherein said deck is angularly oriented at a declining angle away from the shoreline.

8. An assembly as in claim 1 wherein said plurality of modules is defined by a first number of modules forming a front row and being angularly oriented at an incline towards the shoreline and a second number of modules defining a rear row and being angularly oriented at an incline away from the shoreline.

9. An assembly as in claim 8 wherein said first number of modules are disposed in spaced relation to one another along the length of said barrier structure and each are oriented at a common angle relative to the floor of the body of water in which the barrier assembly is mounted.

10. An assembly as in claim 9 wherein said second number of modules are disposed in spaced relation to one another a long the length of said barrier assembly and each being oriented at a common angle relative to the floor of the body of water in which said barrier assembly is mounted.

11. An assembly as in claim 8 wherein said first number of modules is disposed in spaced and staggered relation to one another including a first set of leading modules and alternately a first set of trailing modules.

12. An assembly as in claim 11 wherein said second number of modules is disposed in spaced and staggered relation to one another including a second set of leading modules and alternately a second set of trailing modules.

13. An assembly as in claim 12 wherein each of said first number of modules is oriented at a common angular orientation and each of said second number of modules is oriented at a common angular orientation.

14. An assembly as in claim 12 wherein each of said modules comprises a leading edge having a linear configuration and extending continuously along the length thereof, a plurality of leading edges disposed in spaced relation to one another; each of said modules further comprising a substantialy rounded trailing portion extending along the length thereof and being oppositely disposed to a corresponding one of said leading edges.

15. An assembly as in claim 14 wherein a number of said plurality of modules are connected to one another by an elongated deck secured to said upper ends of said number of modules.

16. An assembly as in claim 8 wherein said first and second number of modules each include an elongated substantially centrally disposed core of high strength material extending along the length thereof and being surrounded by said high strength cementitious material.

17. An offshore erosion protection structure designed to reduce sand erosion from wave action and minimize reflection and comprising:

a barrier assembly anchored to the floor of a body of water and extending upwardly therefrom to a height sufficient to extend above a normal water level, said barrier assembly comprising a plurality of modules formed at least in part from a heavy, reinforced cementitous material and defined by spaced apart, substantially parallel walls including at least a center wall, and two side walls disposed on opposite sides of said center wall, a receiving chamber formed between said center wall and each of said side walls, said barrier assembly including a leading portion defined by a leading wall assembly having an apertured construction to minimize reflection and secured to leading edges of said center and side walls and being disposed in overlying and covering relation to said receiving chamber, said barrier assembly further including a trailing wall assembly having an apertured construction and secured to trailing edges of said center and side walls and being disposed in overlying, covering relation to said receiving chamber, each of said center and said walls being interconnected to one another along an upper end by a deck portion, said deck portion having an elongated configuration of sufficient length to extend between adjacent ones of said center and side walls, anchoring means including at least two angularly oriented anchors adapted to hold said barrier assembly in anchored, fixed position on the floor of the body of water, said anchors each including a base positioned in submerged relation beneath and extending outwardly from the floor of the body of water and attached to inner surface portions of said side walls and extending along a major portion of the height thereof, and wherein said barrier assembly is structured and disposed to force incoming waves to dissipate through its leading and trailing apertured walls and release suspended particles behind the barrier assembly.

18. An assembly as in claim 17 wherein said apertured construction of said leading and trailing wall assemblies comprises a plurality of apertures integrally formed therein and dimensioned to allow water to pass therethrough as water from incoming waves flows into and out of said chambers.

19. An assembly as in claim 18 wherein said leading wall assembly is angularly oriented at an incline towards the shoreline.

20. An assembly as in claim 19 wherein said trailing wall assembly is angularly oriented at an incline away from the shoreline.

21. An assembly as in claim 17 wherein each of said center and side walls comprise a trapezoidal configuration.

22. An assembly as in claim 17 wherein said anchors are secured to and extend along inner surface portions of each of said leading and trailing walls.

* * * * *